US006023867A

United States Patent [19]

Gagné

[11] Patent Number: 6,023,867

[45] Date of Patent: Feb. 15, 2000

[54] SELECTABLE MESSAGE DISPLAY SYSTEM

[76] Inventor: Denis Gagné , 6382 Matte Street, Montreal-North, Canada, H1G 2E8

[21] Appl. No.: 09/115,023

[22] Filed: Jul. 14, 1998

Related U.S. Application Data

[63] Continuation-in-part of application No. 08/685,286, Jul. 23, 1996, abandoned.

[51] Int. Cl.[7] ..... G09F 7/18

[52] U.S. Cl. ..... 40/491; 40/612; 40/606

[58] Field of Search ..... 40/612, 606, 607, 40/605, 610, 617, 491, 492

[56] References Cited

U.S. PATENT DOCUMENTS

| | | | |
|---|---|---|---|
| 479,316 | 7/1892 | Stuart | 40/491 X |
| 778,790 | 12/1904 | Merrill | 40/491 X |
| 1,552,920 | 9/1925 | Glover | 40/492 |
| 1,592,241 | 7/1926 | Welday | 40/492 |
| 1,846,649 | 2/1932 | McFarland | 40/491 |
| 2,345,913 | 4/1944 | Bishop . | |
| 4,318,238 | 3/1982 | Macarle, Jr. | 40/607 |
| 4,999,938 | 3/1991 | Behling | 40/610 |
| 5,218,775 | 6/1993 | Singer | 40/617 |

*Primary Examiner*—Cassandra H. Davis
*Attorney, Agent, or Firm*—Synnestvedt & Lechner LLP

[57] ABSTRACT

A selective message display system comprising a pair of plates facing one another and in a spaced apart relationship to form between them a space. The outer faces of the plates bear insignia, such as parking restriction notifications. A movable display panel is mounted between the plates. The faces of the display panel bear additional insignia that override or complement the parking restrictions on the plates. The display panel can be placed in an exposed position in which it projects laterally from the plates so it is visible to motorists. The display panel can also be retracted between the plates to hide it from view.

14 Claims, 11 Drawing Sheets

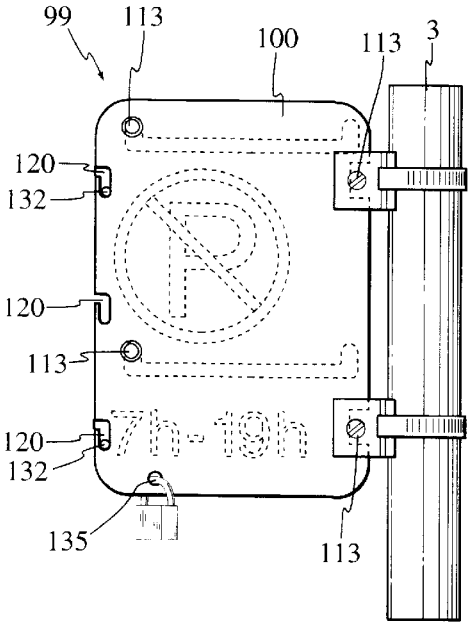
Fig.23
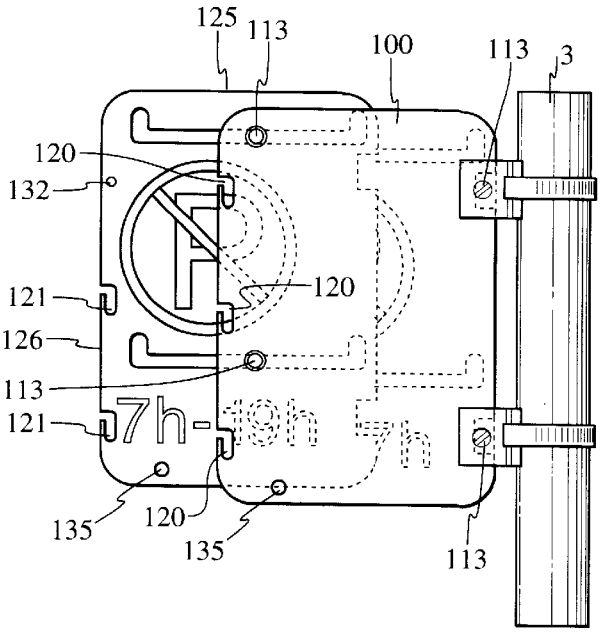
Fig.25
Fig.24
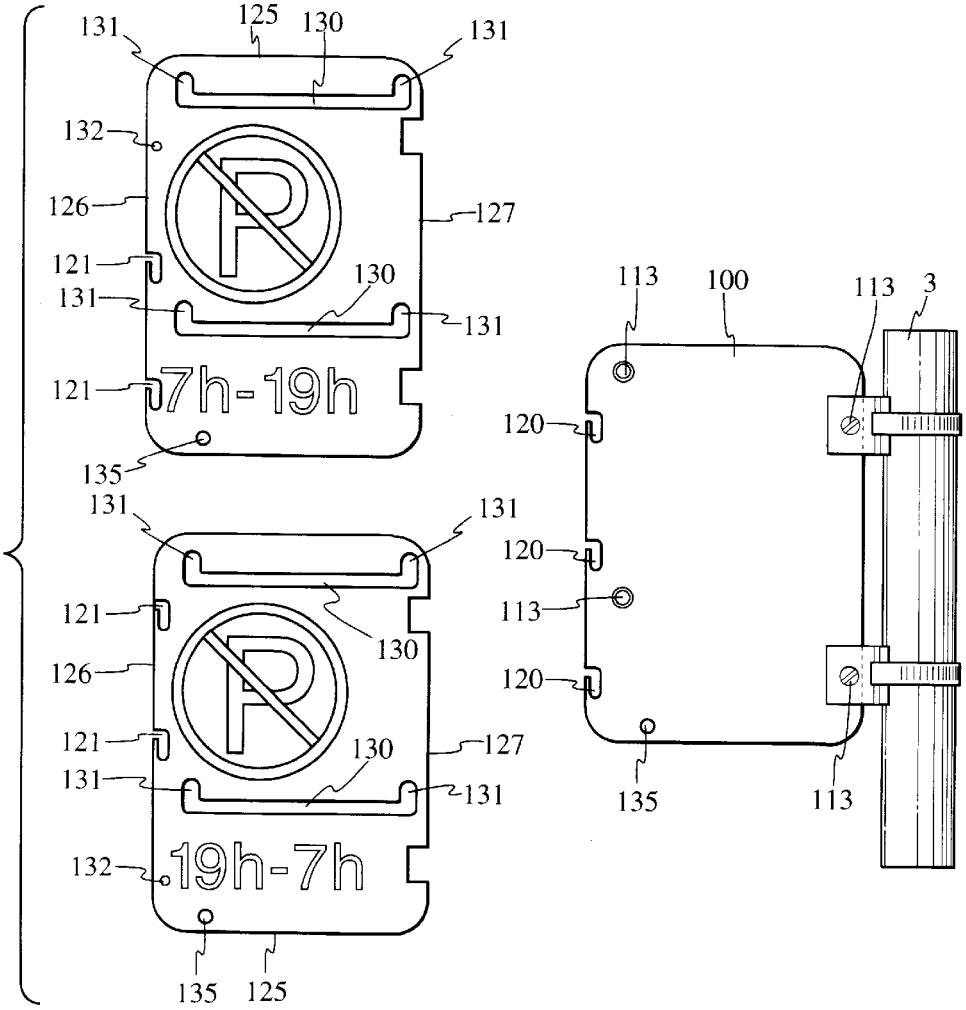

SELECTABLE MESSAGE DISPLAY SYSTEM

RELATED APPLICATION

This application is a Continuation In Part of U.S. Pat. application Ser. No. 08/685,286, now abandoned, filed on Jul. 23, 1996 and claims priority to Canadian Patent No. 2,154,546 filed on Jul. 24, 1995.

FIELD OF THE INVENTION

This invention relates to a display device and, in particular, to a display device assembly capable of selectively displaying a first and a second message.

BACKGROUND OF THE INVENTION

Sometimes, due to special circumstances, such as road construction or maintenance, snow removal, special events, etc, there is a temporary change, for instance, in the parking restrictions. Vehicle owners who do not comply with these new restrictions may then receive a traffic ticket or see their vehicle towed away.

Therefore, it is important that conventional roadsigns be adapted to display a second message to the public indicating this temporary change of conditions and that said message be clearly visible so as to avoid any of the above situations.

Traditionally, this has been accomplished by putting temporary display signs along the street affected by such change of conditions. The type and dimension of these additional display signs varies greatly from one jurisdiction to another, since these operations are generally under the control of public authorities which function independently. The most often used devices consist of a foldable sawbuck type temporary display sign generally made of wood and painted in a striking colour. Such a sign must be posted and removed each time the parking restrictions are modified, which results in large operation and storage costs. Furthermore, such signs are easily displaceable by unauthorized persons, since they are placed on the ground level. This results in potential damage or loss of the signs.

One alternative used in some jurisdictions consists of posting a cardboard panel displaying on each side thereof the new parking restrictions, the panel being mounted on a soft wooden pole which is simply stuck into the snow back that has to be removed. Obviously, unless a base support is added, this device has an application limited to snow removal operations and suffers from the same disadvantages than the preceding described device. Furthermore, this cardboard panel, although cheaper in manufacture, can only be used once since it is ingested by the snowblower and shredded into pieces. This may create environmental problems and has already been forbidden in some jurisdictions.

One recent attempt to avoid the disadvantages of the above devices is shown in U.S. Pat. No. 5,218,775 issued on Jun. 15, 1993 to Singer. There is provided a display device hooked to a conventional sign board comprising a placard and a connecting member fixed to the sign board for hooking the placard, which is provided with a L-shaped slot extending from the upper edge of the placard.

However, this device suffers from many drawbacks. Firstly, it is temporary and requires to be hooked and then removed every time there is a change in parking restrictions. These steps are time consuming and render the whole operation very costly. Secondly, the connecting member requires precise installation on the sign board and may require piercing of additional holes in said board. Thirdly, it results in storage costs and quicker deterioration of the placard given the constant handling. Fourthly, it can be removed by unauthorized persons, resulting in potential damage and/or loss.

There is therefore a need for a display device that does circumvent the inconveniences of the foregoing known devices.

SUMMARY OF THE INVENTION

One object of the invention is to provide a display system which can selectively display a first message and a plurality of messages as need be.

One further object of the present invention is to provide for a simple device that can be used permanently for indicating changes in parking restrictions or the like.

As embodied and broadly described herein, the invention provides a selectable display device, comprising:

a display casing, including a base panel to be affixed to a post, said base panel having an outer face capable of bearing a sign, and a back panel mounted to said base panel in a spaced apart relationship, said back panel having an outer face capable of bearing a sign, each said base panel and said back panel having a plurality of notch located on the opposite side of said post to allow access to a least one display panel located between said base panel and said back panel, said notch on said base panel being in line with said notch on back panel;

a plurality of fastening member to affix said back panel to said base panel and maintain said base panel and said back panel in a spaced apart relationship, said fastening member also serving to guide and to hold said display panel between said base panel and said back panel; fastening member also serving to guide and to hold said display panel between said base panel and said back panel;

at least one display panel positioned in said display casing between said base panel and said back panel, said display panel being movable relative to said display casing, said display panel capable of acquiring a stowed position whereby said display panel is substantially obstructed from view by said display casing, and an exposed position whereby said display panel projects laterally from said display casing, said display panel having opposite main faces capable of bearing (road) signs, said display panel having at least two narrow slots substantially oriented in the direction of the movement of said display panel, said narrow slots having indents at both ends, said narrow slots allowing said display panel to slide on said fastening member, said indents locking said display panel on said fastening member when said display panel is in the stowed position or the exposed position, said display panel including at least one hole located on the opposite side of said post, said hole positioned in line with one of said notch on said display casing, said hole allowing to take hold of said display panel through said notch to impart movement to said display panel.

The main advantage of the selectable display device is that it is permanent. This arrangement eliminates the need to store the display panel and to transport them to the location where parking restriction is required. The selectable display device makes it possible to use only one person on foot or in a small vehicle to change parking signs. There is no need to use a truck to carry the temporary signs to the different locations. A lot of expenses may be saved with the use of the selectable display panel.

As embodied and broadly described herein, the invention also provides a selectable display system, comprising:

a casing, including a pair of generally opposite side walls in a spaced apart relationship, each side wall having an outer face capable of bearing an insignia;

a display panel mounted to said casing, said display panel having opposite main faces capable of bearing respective insignia, said display panel and said casing being movable relative to one another for causing said display panel to selectively acquire a stowed position in which said panel is located between said walls, whereby said main faces are substantially obstructed from view by said side walls, and an exposed position in which said display panel projects from said casing with said opposite main faces being exposed to view.

In a preferred embodiment, the display panel is slidably pulled out from said casing to the exposed position. In a variant, the display panel is pivotally movable between the stowed and the exposed positions.

As embodied and broadly described herein, the invention also provides a display device comprising:

a support member;

a first and second display plates mounted to said support member, each display plate including first and second main faces capable of bearing an insignia, said display plates being mounted to said support for movement between a first display position whereby said first faces of said plates are in a face-to-face relationship and a second display position whereby said second faces of said plates are in a face-to-face relationship.

The advantages of this invention are numerous. The display device is a simple, sturdy structure which does not require any handling and storage and significantly reduces the time of each operation. It cannot be removed easily by unauthorized persons. Furthermore, it can also take advantage of the existing installations and thus reduces the cost of conversion.

As embodied and broadly described herein, the invention further describes a kit of parts for converting a static display sign to a selective message display system, said kit comprising:

a display plate having a main surface capable of bearing an insignia;

means for mounting said display plate in a face-to-face relationship with a static display sign and in a spaced apart relationship with said static display sign, whereby said display plate and said static display sign form a space between them; and a display panel capable of being mounted in said space, said display panel having opposite main faces capable of bearing respective insignia, said display panel being movable with relation to said display plate and said static display sign between a stowed position in which said display panel is located between said display plate and said static display sign, whereby said main faces are substantially obstructed from view by said display plate and said static display sign, and an exposed position in which said display panel projects from said display plate and said static display sign, whereby said opposite main faces are exposed to view.

Other objects and features of the invention will become apparent by reference to the following description and the drawings.

BRIEF DESCRIPTION OF THE DRAWINGS

A detailed description of the preferred embodiments of the present invention is provided hereinbelow, by way of example only, with reference to the accompanying drawings, in which:

FIG. 6 the display panel in its stowed position whereas FIG. 7 shows the display panel in its exposed position;

FIG. 23 is a side elevational view of the display device according to the invention mounted to a vertical post, showing the movable display panel in the stowed position;

FIG. 24 is an exploded side elevational view of the display device according to the invention showing the display casing being mounted to a vertical post and the movable display panel remove from the display casing;

FIG. 25 is side elevational view of the display device according to the invention showing the display panel at the mid point of its travel to or from its stowed position;

Figure 1:
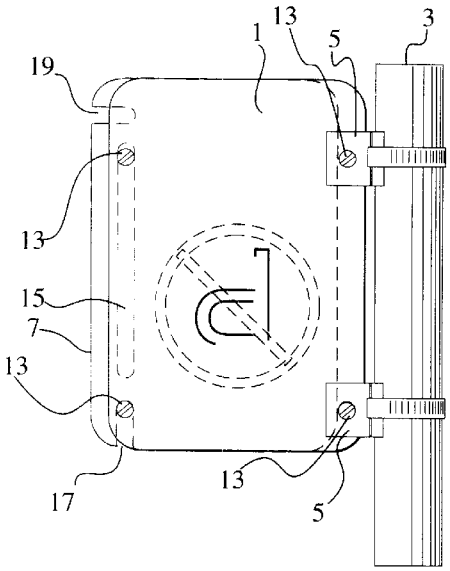
FIG. 1 is a side elevational view of the display device according to the invention mounted to a vertical post, showing the movable display panel in the stowed position.

In the drawings, preferred embodiments of the invention are illustrated by way of examples. It is to be expressly understood that the description and drawings are only for the purpose of illustration and are an aid for understanding. They are not intended to be a definition of the limits of the invention.

DETAILED DESCRIPTION OF THE INVENTION

Figure 23A:
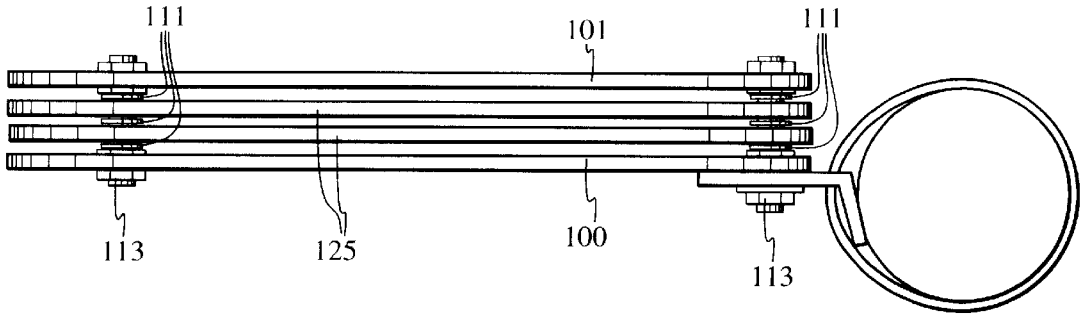
FIG. 23A is a top view of the display device shown in FIG. 23.

A first and preferred embodiment of the invention is shown in FIGS. 23 to 27A. In FIGS. 23 and 23A, there is shown the base panel 100 which is rigidly mounted to the post 3 by suitable brackets an the back panel 101 mounted to the base panel 100, the two of them forming the display casing 99. The back panel 101 and the base panel 100, each have a series of apertures adapted to receive fastening members like rivets, nuts and bolts, screws etc. The back panel 101 and the base panel 100 are maintained in a spaced apart relationship by spacers 111 (in the form of sleeves) receiving the fastening members 113. The back panel 101 and the base panel 100 each have plurality of notches 120 located on the opposite side of post 3 to allow access to a display panel 125 located between base panel 100 and back panel 101, these notches 120 on both base panel 100 and back panel 101 are in line with each other. In the illustrated embodiments, there are as many notches 120 on display casing 99 as there are display panels 125. The back panel 101 and the base panel 100 need only carry signs on there outer faces are there inner faces is completely hidden from view.

At least one display panel is mounted in the display casing 99 by means of two of the spacers 111 and fastening members 113 used to hold together the back panel 101 and the base panel 100. The display panel 125 has two opposite main faces, each displaying the same new message, and is preferably of a distinct color from the display casing 99 to allow the public to easily recognize the change in signalling. As shown in FIG. 24, the display panel 125 has a front edge 126 and a back edge 127. Two long narrow slots 130 oriented substantially perpendicular to front edge 126 preferably extend the width of the display panel 125. At both end of the narrow slots 130 are indents 131 that are used to lock the display panel 125 in its stowed position or its exposed position. The display panel 125 has indents 119 on the back edge 127 to give clearance to fastening member 113 that are used to mount the base panel 100 to the post 3. The display panel 125 has one hole or aperture 132 located directly in line with one of the notches 120 of the display casing 99. This hole or aperture 132 is used to take hold of the display panel 125 with a tool that can be introduced in the hole or aperture 132 and that is capable of reaching the display device which is usually positioned fairly high above ground. The display panel 125 also has notches 121 of similar shape as the notches 120 on the display casing 99 so as to give access to another display panel mounted adjacent to display panel 125. This other display panel is identical to display panel 125 except for the hole or aperture 132 which is aligned with another notch 120 of the display casing 99.

Figure 26:
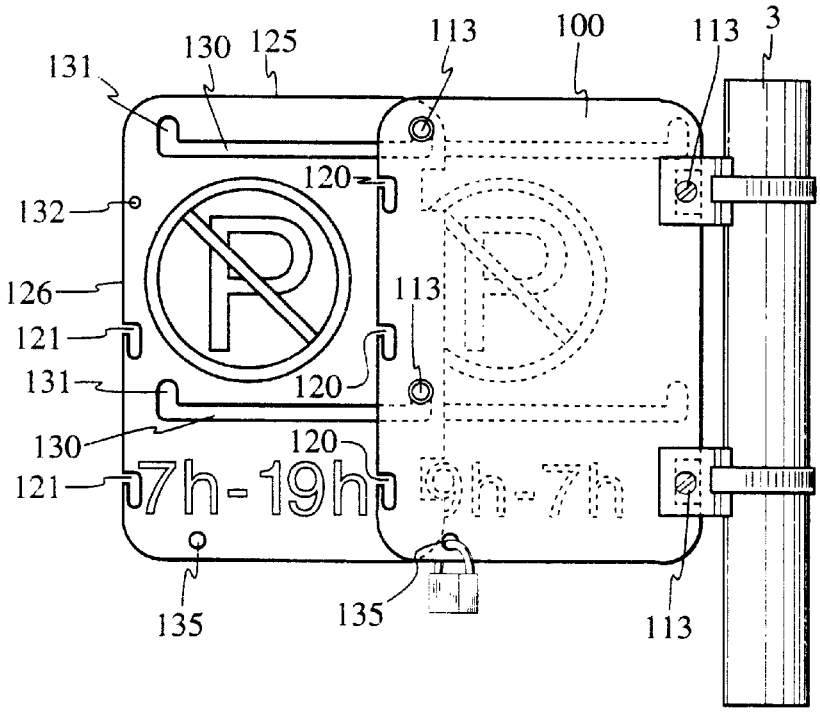
FIG. 26 is a side elevational view of the display device according to the invention mounted to a vertical post, showing the movable display panel in the exposed position.

Holes or apertures 135 are provided in every display panel 125, in back panel 101 and in base panel 100. These holes or apertures 135 are aligned with each other to allow insertion of a locking mechanisms to prevent manipulation of the display device 125 by unauthorized personnel as shown in FIGS. 23 and 26.

Moving the display panel 125 from the stowed position to the exposed position is achieved by introducing the tool in the hole or aperture 132, slightly uplifting the display panel 125 so that the fastening members 113 are disengaged from the indents 131 of the narrow slots 130 in which they currently reside and then sliding the display panel 125 in or out of the display casing 99 until the other indents 131 reach the fastening members 113 and lock the display panel 125 in the new position.

Figure 25A:
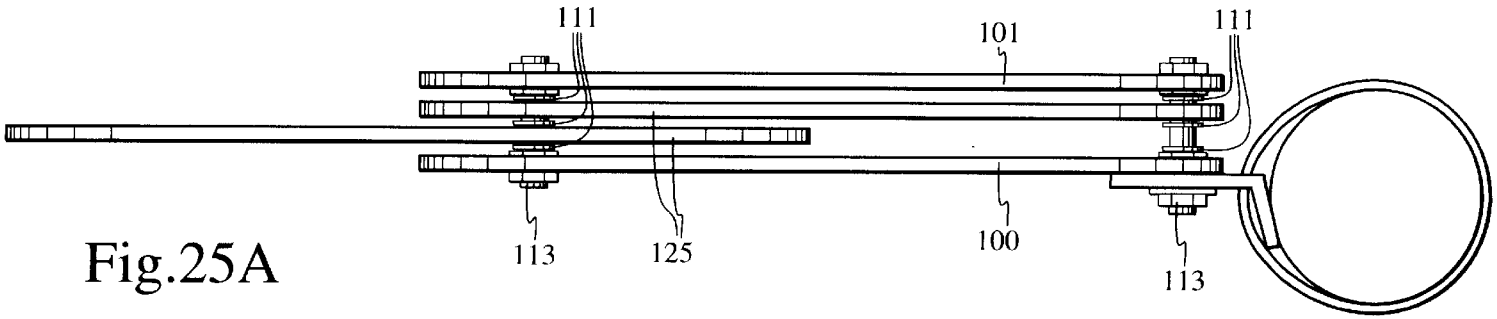
FIG. 25A is a top view of the display device shown in FIG. 25.
Figure 27A:
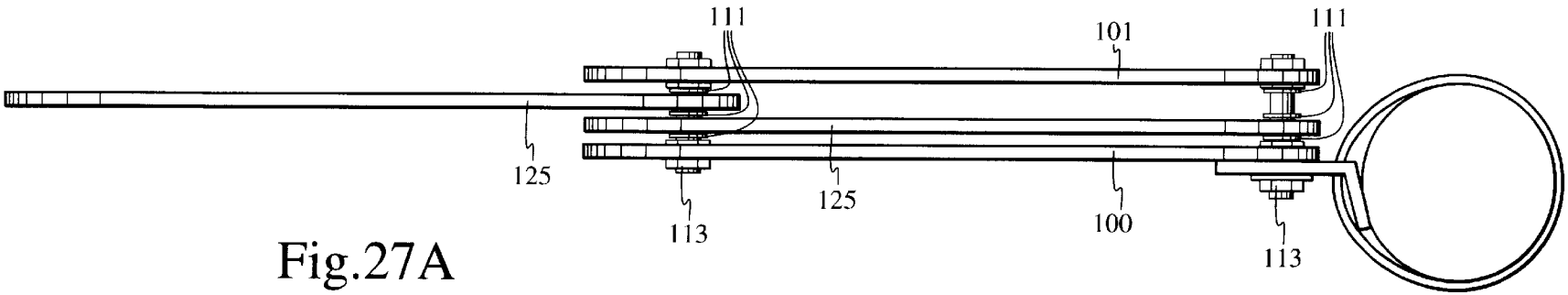
FIG. 27A is a top view of the display device shown in FIG. 27.
Figure 27:
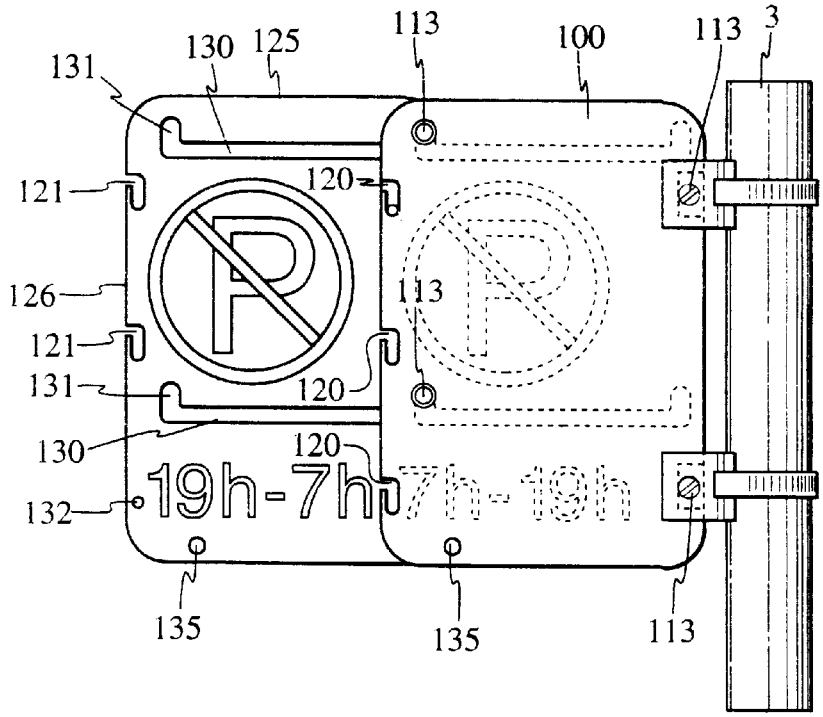
FIG. 27 is a side elevational view of the display device according to the invention mounted to a vertical post, showing a second movable display panel in the exposed position.

FIGS. 23 and 23A show the display panel 125 in its stowed position; FIGS. 25 and 25A show the display panel 125 between its stowed position and its exposed position; and FIGS. 26, 27 and 27A show one or the other display panel 125 in there exposed position.

The display panel 125 is able to stay parallel to the display casing 99 by means of gravity forcing the indents 131 of the narrow slots 130 onto the fastening members 113 which lock the upper part and the lower part of the display panel 125 in their predetermined positions.

Figure 2:
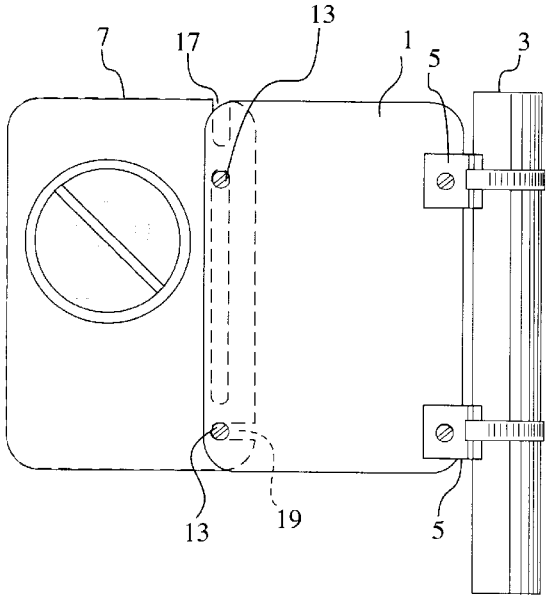
FIG. 2 shows the display device of FIG. 1 showing the display panel in the exposed position.
Figure 3:
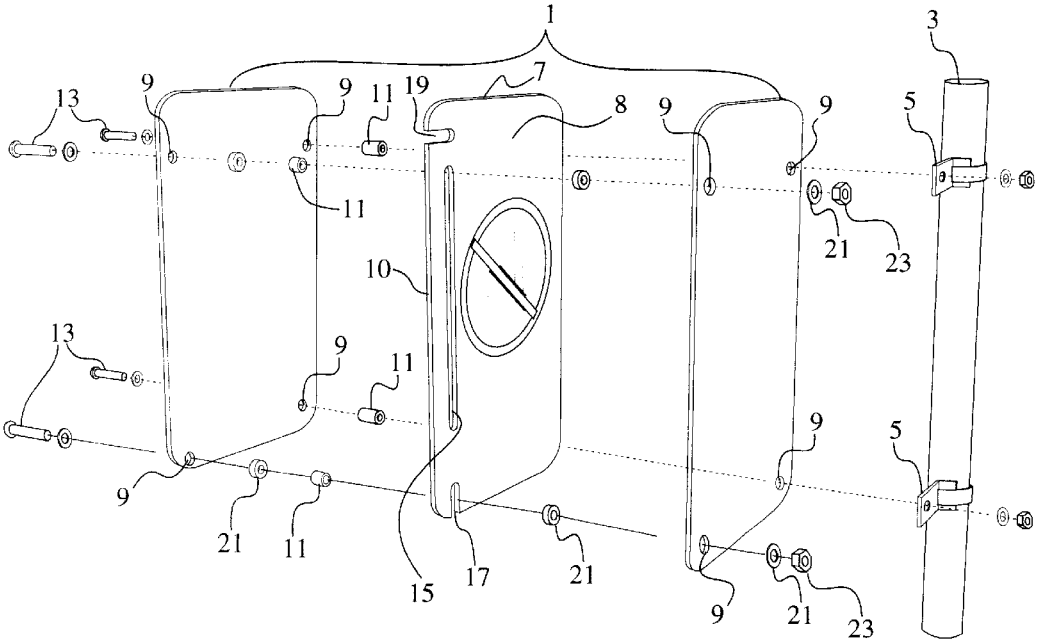
FIG. 3 is a perspective view of the display device of FIG. 1.

A second embodiment of the invention is shown on FIGS. 1 to 5. Turning to FIG. 3, there is shown a pair of generally rectangular plates 1 forming the side walls of a casing and rigidly mounted to a post 3 by suitable brackets 5. Each plate 1 has a series of apertures 9 adapted to receive mounting screws 13. The plates 1 are maintained at a distance from one another by spacers 11 in the form of sleeves receiving the mounting screws 13. Since the plates are in substantial alignment, they need only carry one message on the face thereof which can be seen from the two opposite directions.

A movable display panel 7 is movably mounted between the plates 1 by the intermediary of the spacers 11. The panel 7 has two opposite main faces 8, each displaying a second message, and a peripheral edge 10. A vertical longitudinal slot 15 extends along one edge 10, the slot being dimensioned to slidably receive one of the spacers 11. The display panel 7 further includes one vertical U-shaped slot 17 originating at bottom and being in substantial alignment with the slot 15. It also includes an horizontal U-shaped slot 19 opening from one edge thereof over and adjacent the upper extremity of the slot 15. Both slots serve to stabilize the panel 7 when it is maintained in either of a first stowed position or a second exposed position.

Turning now to FIGS. 1 and 2, FIG. 1 shows the plates 1 mounted on the post 3 in alignment so that only one side of each plate is visible from either side. The display panel 7 is shown (illustrated partly in phantom lines) in an upside down position, the panel being held in place by the upper left screw 13 engaging the lower extremity of the longitudinal slot 15 whereas the lower left screw 13 engages the slot 17 and thus stabilizes the panel in that position. FIG. 2 shows the display panel 7 in the exposed position. The panel 7 is maintained in place by the upper left screw 13 engaging the upper extremity of the longitudinal slot 15 whereas it is stabilized in an upright position by the horizontal slot 19 engaging the lower left screw 13.

Figure 4:
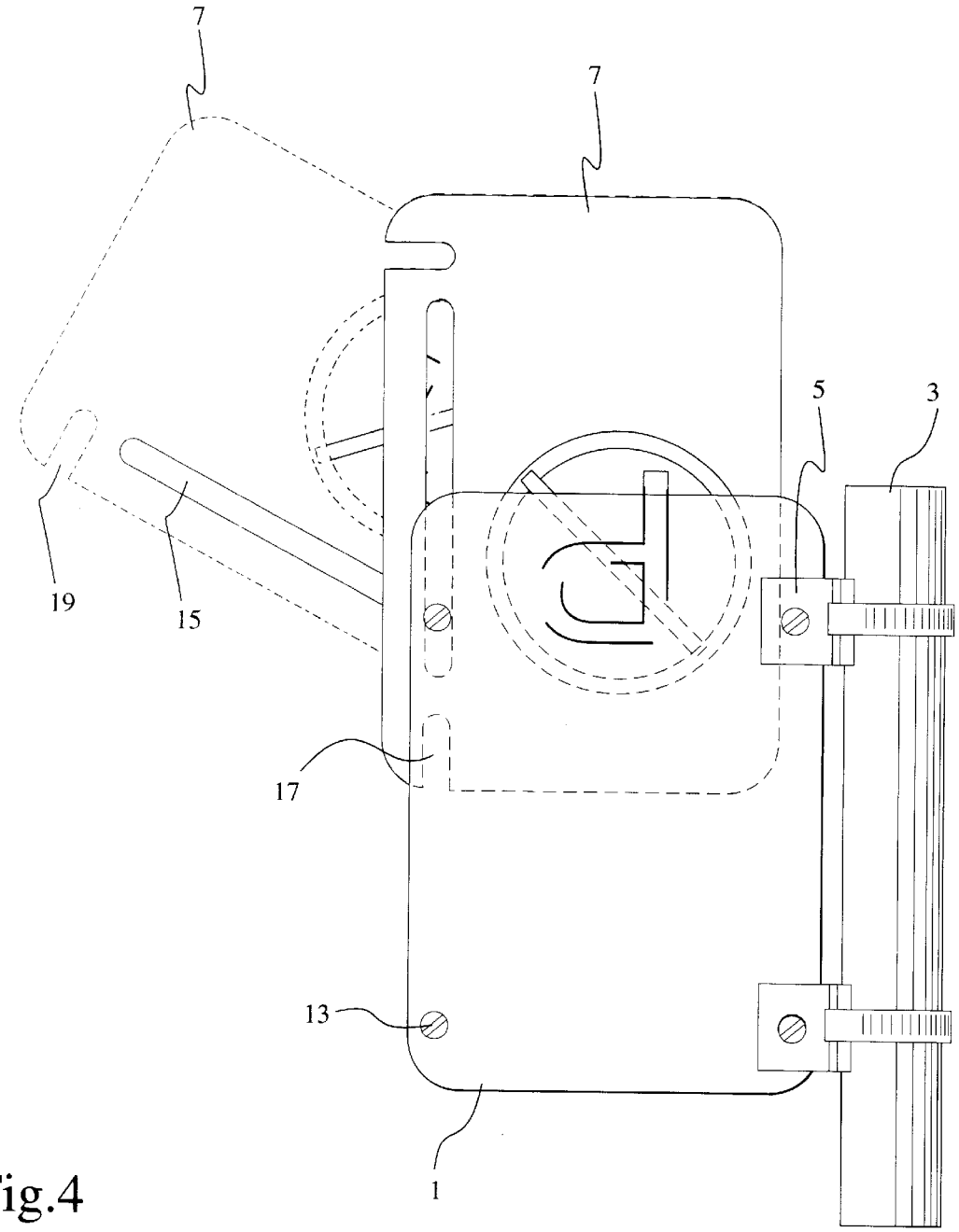
FIG. 4 is an elevational view of the display device of FIG. 1 showing how the display panel is moved from the first stowed position to the second exposed position.

FIG. 4 shows how the panel 7 is moved from the stowed position to the exposed position by vertically uplifting the panel, which causes the longitudinal slot 15 to slide on the upper left screw 13 until the extremity of the slot 15 is reached. Then, the panel is toppled down to an upright position and the slot 19 is engaged over the lower left screw 13.

Typically, both plates 1 carry a parking restriction sign, indicating to motorists the hours of the day at which parking is allowed, or conversely disallowed. On the other hand, display panel 7 would carry a 24 hour no parking sign. In the normal position i.e. the display panel 7 concealed between the plates 1, the parking restriction sign only is visible. By extending the display panel 7, the 24 hour no parking sign now becomes visible and overrides the normal parking schedule on the street.

Figure 5:
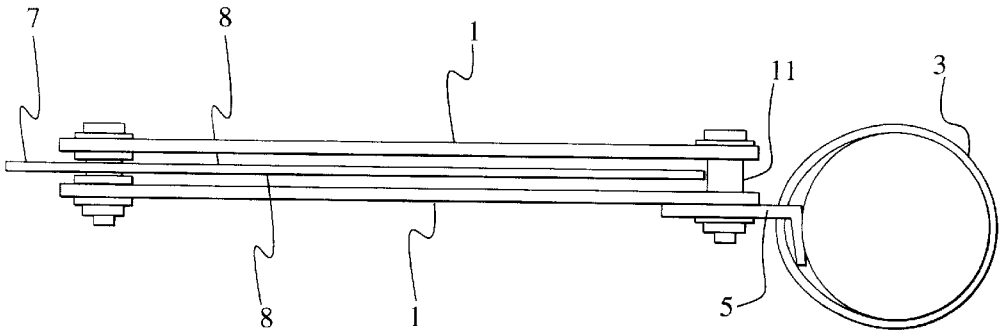
FIG. 5 is a plan view of the display device of FIG. 1.

As shown in FIG. 5, the leading edge of the panel 7 slightly projects from the two plates 1 when the panel is in the stowed position. This projection allows for easy grasp of the panel 7, either with fingers or a suitable pole (in the case of installations where the display device is mounted too high to be reached by hand) to move it to the exposed position.

Figure 6:
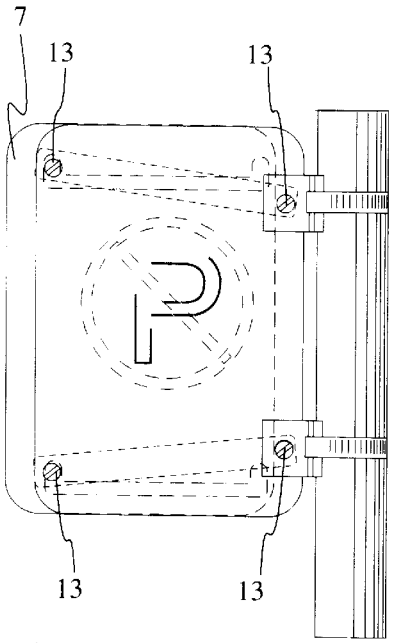
FIGS. 6 and 7 elevational views of a display device according to a second embodiment.

FIGS. 6 to 9 show a simplified embodiment of the display device shown in FIGS. 23 to 27A. The display panel 7 comprises two parallel longitudinal grooves 25 extending horizontally along the top and the bottom edges thereof. The grooves 25 end at each extremity with short vertical slots 27 intended to lock the display panel 7 either in the stowed or in the exposed position. FIG. 6 shows the display device in the stowed position where the display panel 7 is nested between the plates 1. Note that only the screws 13 that are near the left side (as shown in FIG. 6) of the display device engage the horizontal grooves 25. The screws 13 near the post 3 are located outside the grooves 25.

Figure 7:
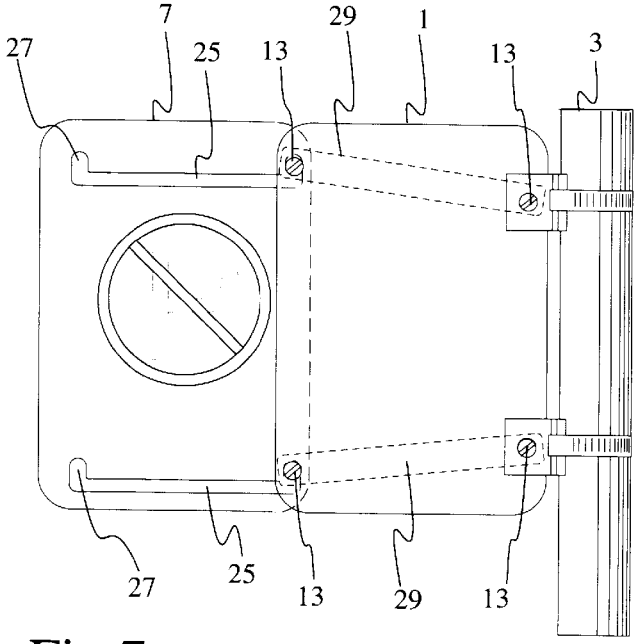

FIG. 7 shows the display device in the exposed position. Moving the display panel 7 between the stowed position and the exposed position is achieved by slightly uplifting the panel 7 so that the screws 13 are disengaged from the slots 27 in which they currently reside and then sliding the panel 7 in or out until the screws 13 are brought in the opposite slots 13.

Figure 8:
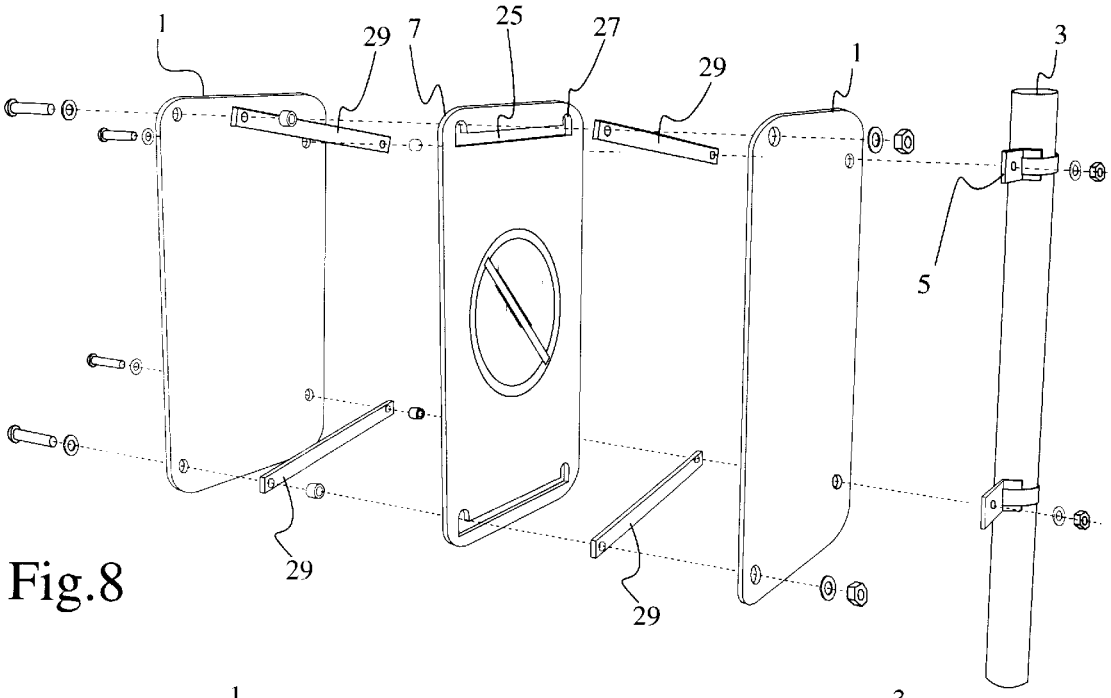
FIG. 8 is a perspective exploded view of the display device of FIGS. 6 and 7.
Figure 9:
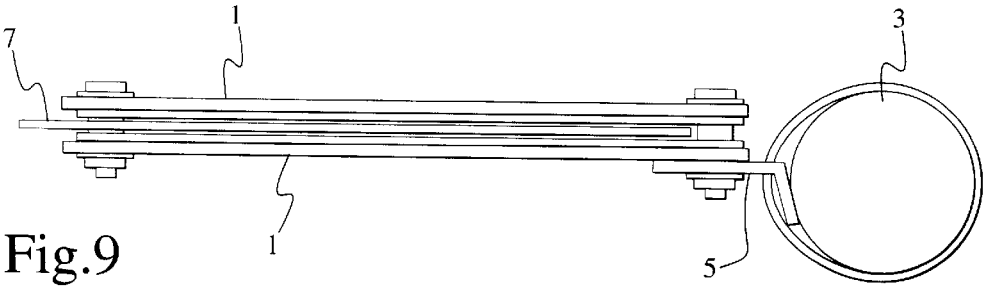
FIG. 9 is a plan view of the display device of FIGS. 6 and 7.
Figure 10:
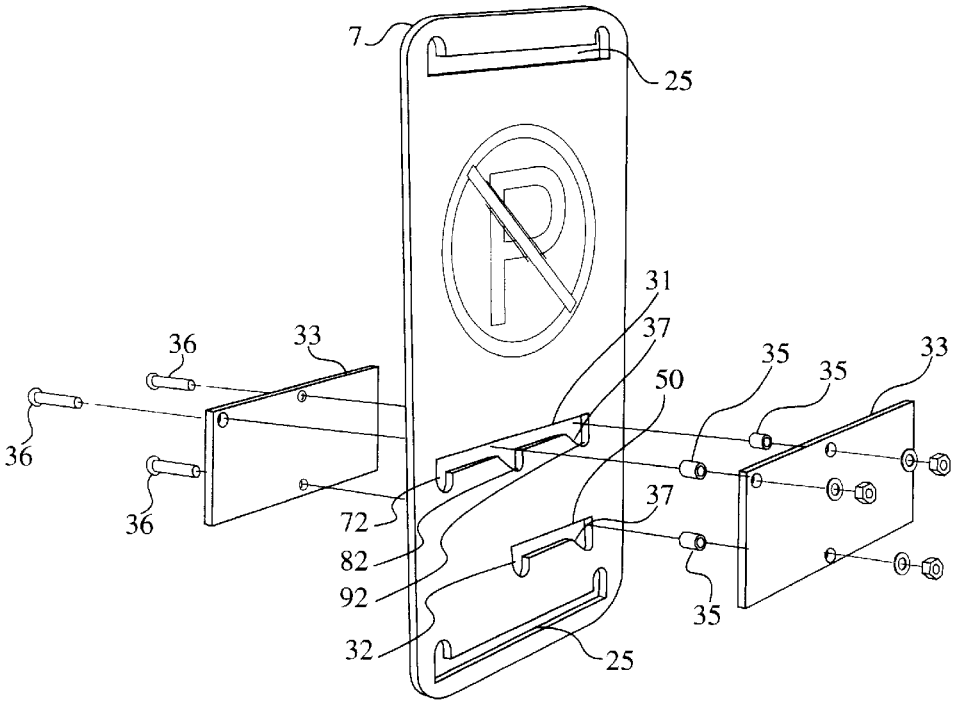
FIG. 10 is a perspective exploded view of the movable display panel according to a variant, featuring a shutter for blocking selected messages on the display panel and/or adding new messages on the display panel.
Figure 11:
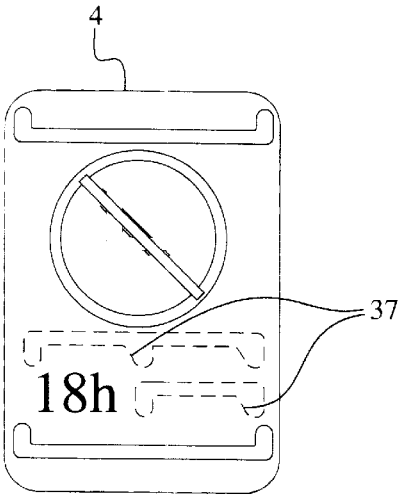
FIG. 11 is an elevational of the display panel shown in FIG. 10.
Figure 12:
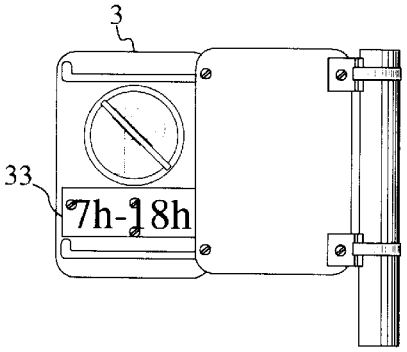
FIGS. 12 and 13 are elevational views of the display device using the movable display shutters shown in FIGS. 10 and 11.

The embodiment shown in FIG. 8 features shims 29 mounted between each plate 1 and the display panel 7. The shims are held in place by the screws 13 and serve to take-up the free space on each side of the panel 7 and also guide the panel as it moves relative to the plates 1. Advantageously, the shims 29 can be made of low friction material to facilitate the movement of the panel 7.

FIGS. 10 to 13 show the display device according to a third embodiment wherein the display panel 7 includes a third and fourth horizontal longitudinal grooves 31 and 50, the groove 50 being approximately half the length of the groove 31. The grooves 13 and 50 further define vertical slots 32, 62, 72, 82 and 92 extending downwardly. A pair of rectangular plates 33 are slidably mounted on each side of the display panel 7. The plates 33 are retained to one another by screws 36 carrying spacers 35 in the form of sleeves dimensioned to engage the grooves 31, 50 and the respective slots 32, 62, 72, 82 and 92. A total of three screws 35 hold the plates 33 together. Two screws engage the horizontal groove 31, while a single screw engages the groove 50.

Figure 13:
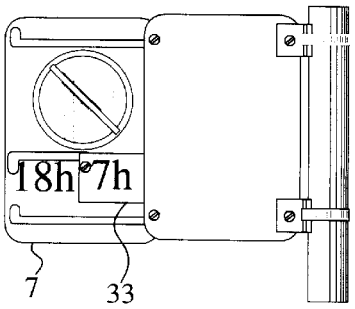

The plates 33 can be set in two different positions on the display panel 7. In a first position, the plates 33 are centred on the display panel 7 (FIG. 12), while in the second position the plates 33 project laterally from the display panel 7 (FIG. 13). By placing markings such as time of the day indications on the plates 33 and on the display panel 7 between the grooves 31 and 50, a multi-message display system is created, allowing to vary the message by changing the position of the plates 33. In the example shown, the plates 33 bear the message 7*h*–18*h*, while the display panel 7 shows 18*h*. In the first position, when the plates 33 cover the message 18*h*, the parking restriction extends from 7*h* to 18*h*. However, by moving the plates 33 sideways, the last portion of its message, i.e. 18*h* is hidden between the plates 1, while revealing the 18*h* message on the display panel 7. Thus, the parking restriction now in force becomes 17*h*–7*h*.

In a most preferred embodiment, the plates 33 are designed to return to their centered position with relation to display panel 7 when the latter is stowed between the plates 1. This is achieved by providing oblique camming surfaces 37 in the slots 62, 82, and 92 that cause the plates 33 to rise in the grooves 31, 50 as the plates 33 are moved to the left (with reference to FIG. 10). Thus, when the display panel 7 is moved to the stowed position, the extended plates 33 engage the post 3, or any other suitably located abutment, and they are automatically retracted over the display panel 7.

Figure 14:
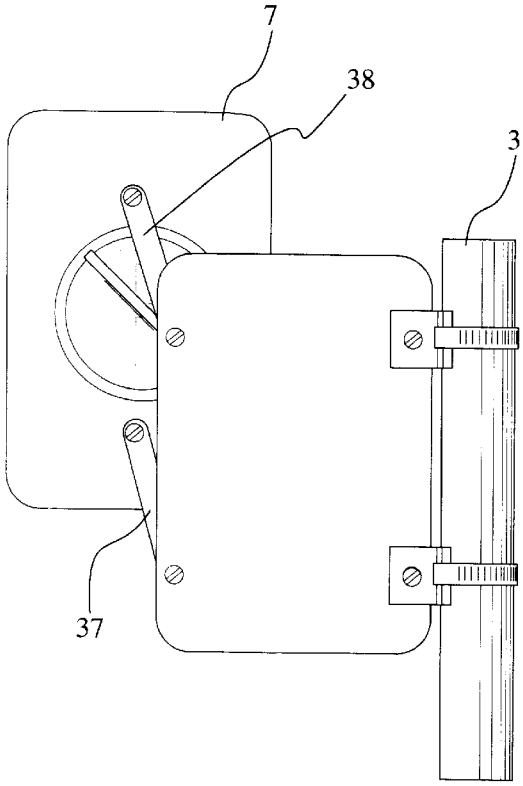
FIG. 14 is an elevational view of the display device according to a third embodiment, the movable panel being shown at mid point between the exposed and the stowed positions.
Figure 15:
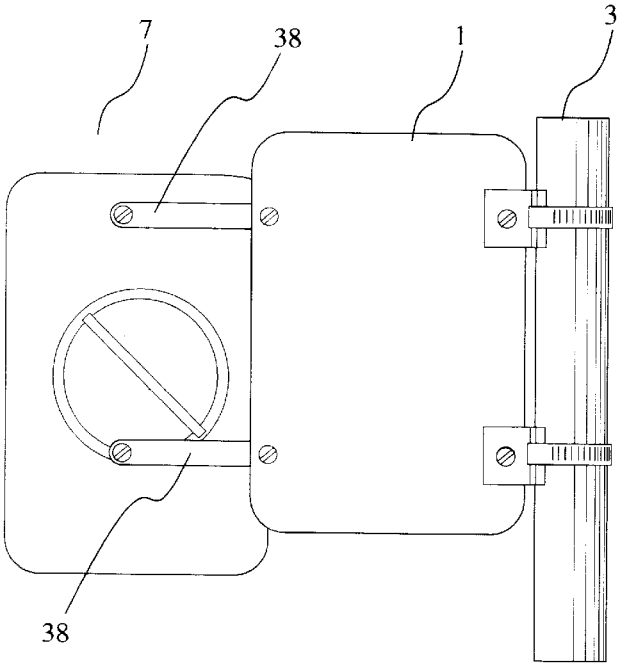
FIG. 15 is an elevational view of the display device of FIG. 14, depicting the display panel in the exposed position.
Figure 16:
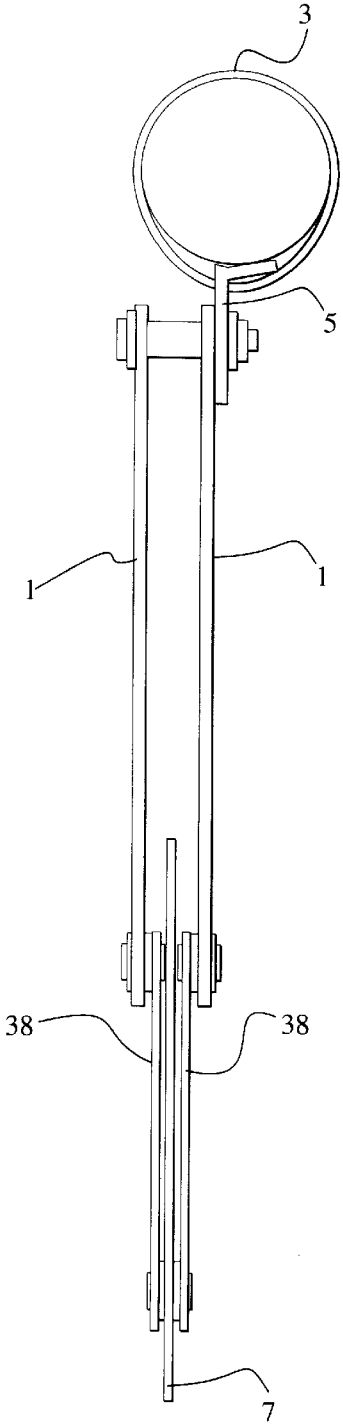
FIG. 16 is a plan view of the display device shown in FIG. 14.

FIGS. 14 to 16 show a fourth embodiment of the invention. The display panel 7 is mounted between the plates 1 by way of parallel brackets 38 pivotally mounted on both the panel and a respective plate 1. The brackets 38 allow the display panel 7 to move along a circular path between the stowed position and the exposed position. Suitable abutments (not shown in the drawings) are provided to prevent the display panel from moving beyond the position shown in FIG. 15.

Figure 17:
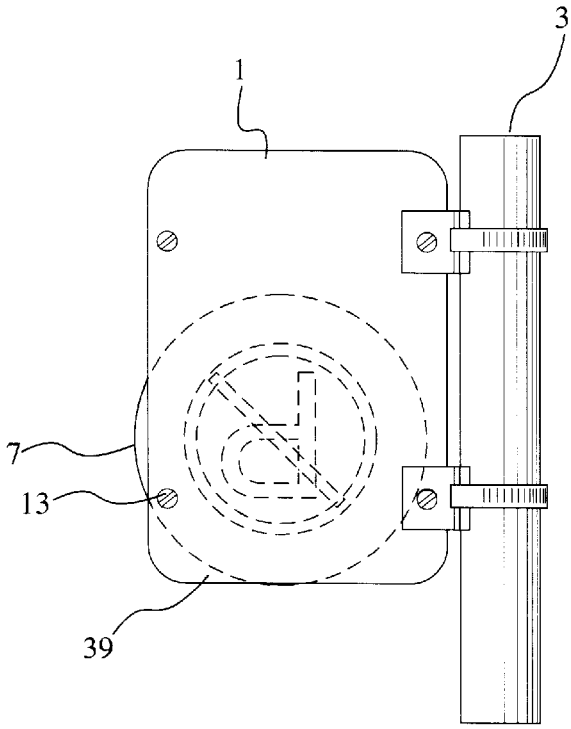
FIG. 17 is an elevational view of the display device according to a fifth embodiment featuring a circular movable panel.
Figure 18:
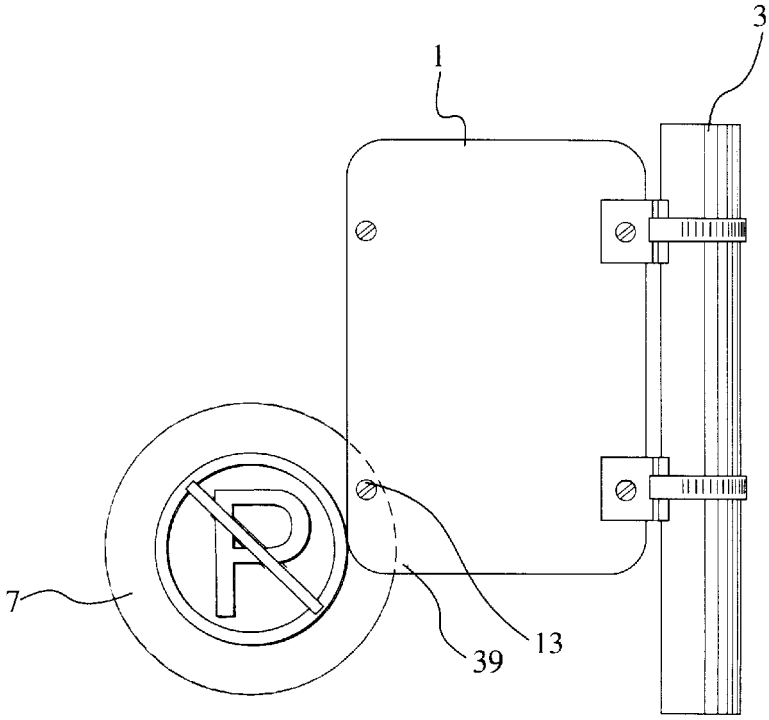
FIG. 18 is an elevational view of the display device of FIG. 17, showing the movable panel in its exposed position.

FIGS. 17 and 18 show a fifth embodiment of the invention. The display panel 7 is circular and is mounted in between the plates 1 by a screw 13 forming a pivot. The panel 7 can be moved from a stowed position (as shown in FIG. 17) to the exposed position (as shown in FIG. 18) by pivoting the panel about the screw 13. An abutment 39 extending between the plates 1 locks the panel 7 in either the stowed or the exposed position.

Figure 19:
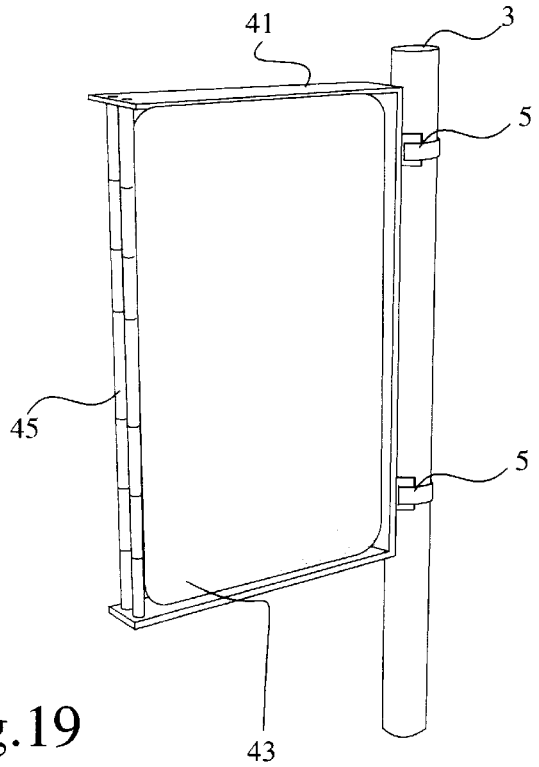
FIG. 19 is a perspective view of the display device according to a sixth embodiment featuring two hinged display panels.
Figure 20:
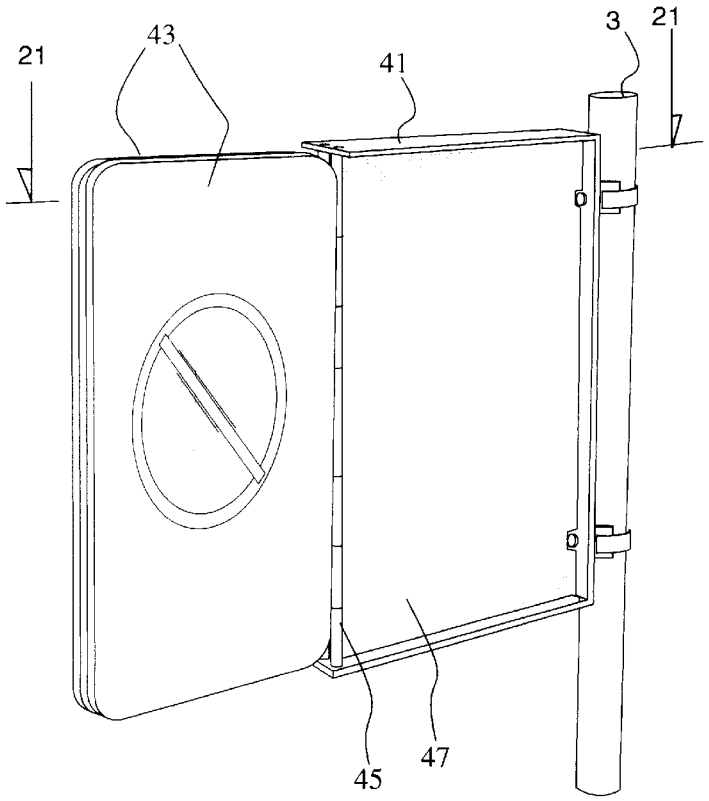
FIG. 20 is a perspective view of the display device of FIG. 19, the hinged panels opened to display a second message and also showing an optional display plate mounted within the frame.
Figure 21:
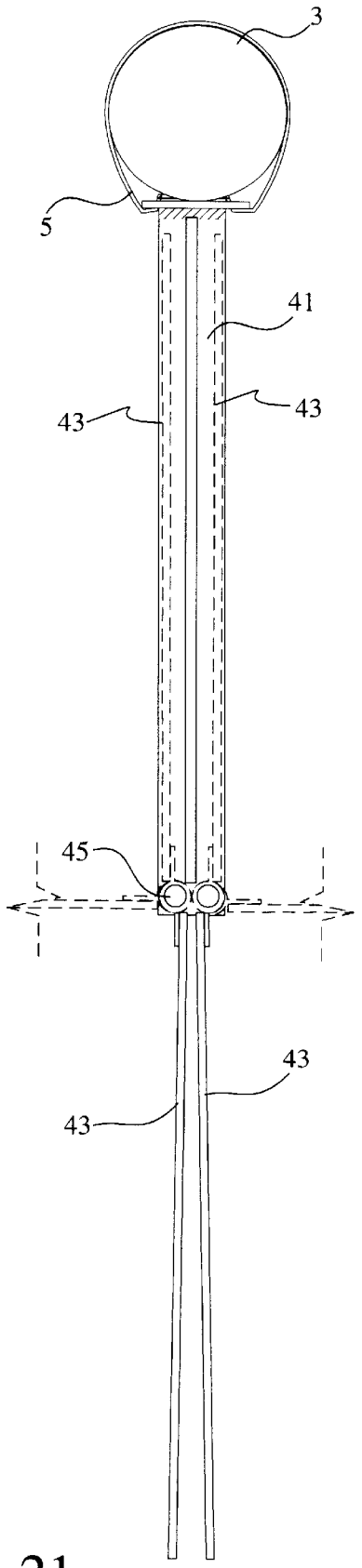
FIG. 21 is a plan view of the display device shown in FIG. 20, the optional display plate being omitted.

FIGS. 19 to 21 show a sixth embodiment of the present invention. The display system comprises a support member 41 mounted on a post 3 by suitable brackets 5. The support can be of any shape and can be integral with the post 3. Conveniently, it is a U-shaped frame the open side thereof being opposite the post 3. Two panels 43 are hingedly mounted within the support member 41 in substantial alignment. Each main face of the panels 43 can bear an insignia. A hinge 45 connects each panel to the support 41 and allows for displacement of the panels from a first display position (as shown in FIG. 19) whereby one main face of each panel 43 is exposed and a second display position (as shown in FIG. 20) whereby the other main face of each panel is exposed.

The embodiment depicted in FIG. 20 includes an optional panel 47 mounted within the frame 41. The additional panel 47, that may bear additional information, is revealed only when the panels 43 are moved toward the second position.

Figure 22:
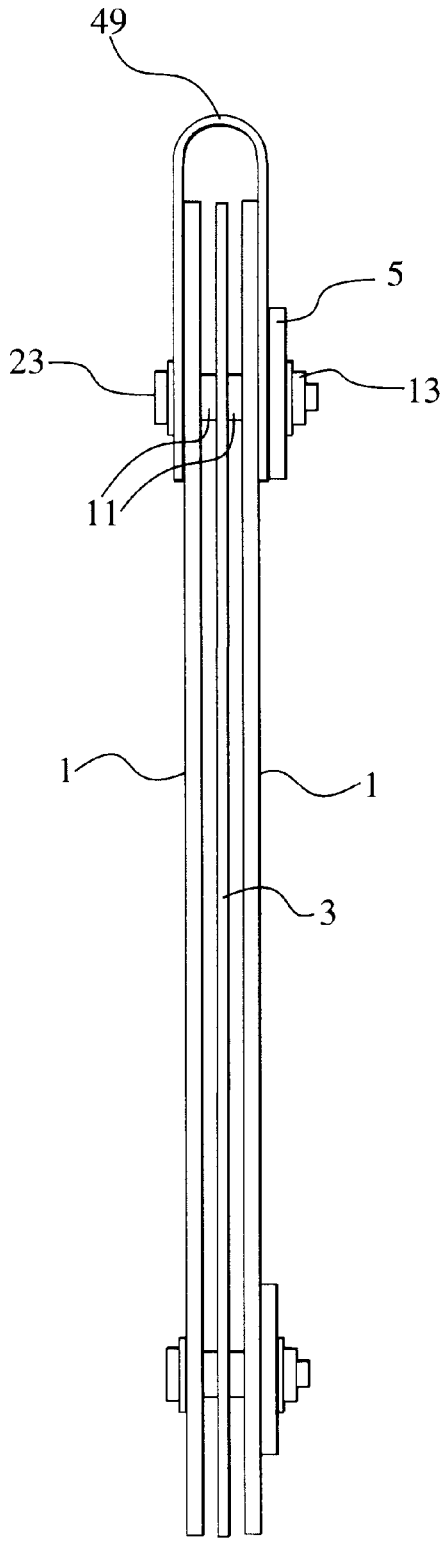
FIG. 22 is an elevational view of the display device according to a seventh embodiment showing a top web connecting the display panels.

FIG. 22 illustrates a further variant featuring an arched cover 49 connecting the plates 1 to prevent ingress of water and other elements. Conveniently, this web 49 may be integral with said panels and therefore form the casing. In the embodiments requiring horizontal displacement, a bottom web (not shown) may connect the bottom extremities of each wall and may conveniently be integral with said panels so that the panels and two webs form an enclosure receiving the panel.

It will be apparent for those skilled in the art that the number of panels between the walls is not limited to one and more than one panel can be conveniently use to bear several insignias. Similarly, any known way for displacing the panel between the stowed and the exposed position, such as guide rails, rollers, "X" braces, etc., would equally work. Furthermore, it will be apparent that the displacement of the panel can be accomplished manually or automatically by any known means.

Advantageously, the display system in accordance with the invention, can be made available as a kit for converting a conventional single plate display sign. More specifically, the kit includes one plate and mounting hardware to attach it to the existing sign forming the other plate of the casing. Also included in the kit is the movable display panel.

The above description of preferred embodiments should not be interpreted in a limiting manner since other variations, modifications and refinements are possible within the spirit and scope of the present invention. The scope of the present invention is defined in the appended claims and their equivalents.

I claim:

1. A selectable display device, comprising:

a display casing, including a base panel to be affixed to a post, said base panel having an outer face capable of bearing a sign, and a back panel mounted to said base panel in a spaced apart relationship, said back panel having an outer face capable of bearing a sign;

at least one display panel;

a plurality of fastening members to affix said back panel to said base panel and maintain said base panel and said back panel in a spaced apart relationship, said fastening members also serving to guide and to hold said at least one display panel between said base panel and said back panel;

said at least one display panel positioned in said display casing between said base panel and said back panel, said at least one display panel being movable relative to said display casing, said at least one display panel capable of acquiring a stowed position whereby said at least one display panel is substantially obstructed from view by said display casing, and an exposed position whereby said at least one display panel projects laterally from said display casing, said at least one display panel having opposite main faces capable of bearing signs, said at least one display panel having at least two narrow slots substantially oriented in the direction of the movement of said at least one display panel, said narrow slots having indents at both ends, said narrow slots allowing said at least one display panel to slide on said fastening members, said indents locking said display panel on said fastening members when said at least one display panel is in the stowed position or the exposed position, each said base panel and said back panel having a plurality of notches located on one side to allow access to at least one said at least one display panel located between said base panel and said back panel, said notches on said base panel being in line with said notches on back panel, said at least one display panel including at least one hole positioned in line with one of said notches on said base panel and said back panel.

2. A selectable display device as defined in claim 1, wherein said notches have a reversed L shape.

3. A selectable display device as defined in claim 1, wherein said at least one display panel is provided with notches similar to said notches on said base panel and said back panel, said notches of said at least one display panel in line with said notches of said base panel except where said hole is located, whereby said notches of said at least one display panel allow access to other at least one display panels inside said display casing.

4. A selectable display device as defined in claim 1, wherein said at least one display panel has second indents on its back edge to give clearance to said fastening members that are used to affix said base panel to said post when said at least one display panel is in the stowed position.

5. A selectable display device as defined in claim 1, wherein said base panel, said back panel and said display panels each have a hole located in the same coordinate position and in line with each other when said display panel is in the stowed position to allow locking of said display panels in said stowed position.

6. A selectable display device as defined in claim 1, wherein said base panel, said back panel and said display panel are made of metal.

7. A selectable display device as defined in claim 6, wherein said base panel, said back panel and said display panel are fluorescent.

8. A selectable display device as defined in claim 1, wherein said base panel, said back panel and said display panel are made of plastic.

9. A selectable display device as defined in claim 8, wherein said base panel, said back panel and said display panel are fluorescent.

10. A selectable display device as defined in claim 1, wherein said base panel, said back panel and said display panel are made of a harden resin and fiber material.

11. A selectable display device as defined in claim 10, wherein said base panel, said back panel and said display panel are fluorescent.

12. A selectable display device as defined in claim 1, wherein said display panel is completely hidden from view when in the stowed position.

13. A selectable display device as defined in claim 1, wherein said sign is a road sign.

14. A kit of parts for converting a static display sign to a selective message display system, said kit comprising:

a back panel adapted to be mounted to a static display sign in a spaced apart relationship to form a display casing, said back panel having an outer face capable of bearing a sign;

a plurality of fastening members adapted to affix to said back panel to said static display sign and maintain said back panel and said static display sign in a spaced apart relationship, said fastening members also serving to guide and to hold at least one display panel between said back panel and said static display sign; and said at least one display panel adapted to be positioned in said display casing between said back panel and said static display sign, said at least one display panel being movable relative to said display casing, said at least one display panel capable of acquiring a stowed position whereby said at least one display panel is substantially obstructed from view by said display casing, and an exposed position whereby said at least one display panel projects laterally from said display casing, said at least one display panel having opposite main faces capable of bearing signs, said at least one display panel having at least two narrow slots substantially oriented in the direction of the movement of said at least one display panel, said narrow slots having indents at both ends, said narrow slots allowing said at least one display panel to slide on said fastening members, said indents locking said at least one display panel on said fastening members when said at least one display panel is in the stowed position or the exposed position, each said back panel having a plurality of notches on one edge to allow access to at least one said at least one display panel located between said back panel and said static display sign, said at least one display panel including at least one hole positioned in line with one of said notches on said back panel.

* * * * *